United States Patent [19]

Bugg

[11] Patent Number: 4,672,371

[45] Date of Patent: Jun. 9, 1987

[54] DATA DISPLAY ARRANGEMENTS

[75] Inventor: Richard E. F. Bugg, Coulsdon, England

[73] Assignee: U.S. Philips Corporation, New York, N.Y.

[21] Appl. No.: 696,629

[22] Filed: Jan. 31, 1985

[30] Foreign Application Priority Data

Feb. 27, 1984 [GB] United Kingdom ..... 8405069

[51] Int. Cl.[4] ..... G09G 1/14

[52] U.S. Cl. ..... 340/749; 340/735; 340/721; 340/790

[58] Field of Search ..... 340/735, 747, 748, 749, 340/750, 790, 799, 721; 178/30

[56] References Cited

U.S. PATENT DOCUMENTS

| | | | |
|---|---|---|---|
| 4,329,710 | 5/1982 | Taylor | 358/81 |
| 4,439,761 | 3/1984 | Fleming et al. | 340/748 |
| 4,451,825 | 5/1984 | Hall et al. | 340/735 |
| 4,485,378 | 11/1984 | Matsui et al. | 340/750 |

*Primary Examiner*—Gerald L. Brigance
*Assistant Examiner*—Jeffery A. Brier
*Attorney, Agent, or Firm*—Robert T. Mayer; Bernard Franzblau

[57] ABSTRACT

A character memory of a data display arrangement is divided into a plurality of separate memory sections which are available to provide characters for display only for respective sub-areas of a display screen. The invention is especially suited to providing high resolution character-based displays using so-called dynamically redefinable characters sets. A memory map MM containing the memory sections is addressed by a counter COU. A latch L2 initially sets the counter COU to the address of the first memory section. During each line scanning period a ÷2 divider DV is responsive to character column pulses CP to step the counter COU to address a new memory section address evey second character position. At the end of each line scanning period line pulses LP reset the counter COU to the first memory section address. In a modification, the connections of the address bus between the counter and the memory map are altered so that the addresses as actually applied to the memory sections are only changed every second (or fourth) character position so that less memory is needed.

9 Claims, 7 Drawing Figures

DATA DISPLAY ARRANGEMENTS

BACKGROUND OF THE INVENTION

1. Field of the Invention

This invention relates to data display arrangements of a type for displaying as an entity on the screen of a CRT (cathode ray tube) or other raster scan display device, a quantity of stored data which is accessed repeatedly for its display in a recurrent cycle of scanning lines, the displayed data being composed of discrete characters organized in character rows each comprising a plurality of character positions, and the shape of each discrete character being defined by selected dots of a dot matrix which constitutes a character format for the characters.

2. Description of the Prior Art

Data display arrangements of the above type are used in a variety of different applications. For instance, one such data display arrangement is used in conjunction with telephone data services which offer a telephone subscriber having a suitable video terminal (incoporating the arrangement), the facility of access over the public telephone network to a data source from which data can be selected and transmitted to the subscriber's premises for display. Examples of this usuage are the British and German videotext services Prestel and Bildschirmtext.

A data display arrangement of the above type includes, in addition to the CRT or other raster scan display device, acquisition means for acquiring from a data source transmission information representing data selected for display, a display memory for storing digital codes derived from the transmission information, and character generator means for producing, from the stored digital codes, character generating signals for driving the display device to produce the data display.

The character generator means normally includes a fixed character memory in which is stored character information identifying the available character shapes which can be displayed by the arrangement. This character information is addressed selectively in accordance with the stored digital codes in the display memory, and the information read out is used to produce the character generating signals for the data display. This selective addressing is effected synchronously with the scanning action of the display device, which scanning action may be effected with or without field interlacing.

With a view to extending the display facilities of a data display arrangement of the above type, it has been proposed to increase the number of character shapes which are available for selection to form a display by providing the arrangement with a number of so-called "dynamically redefinable character sets" (DRCS) which are available at a remote data source from which they can be transmitted selectively to the arrangement for temporary storage as part of the overall character memory. In principle, DRCS characters can have any alpha-mosaic (including alpha-numeric) shape, so that the total possible number of different shapes that can be made available is limited only by the character format used. Thus, DRCS characters can be defined as elements for constructing, with high resolution, graphics such as maps, and geometric and other drawings. (For the purposes of the present specification the term "DRCS character" is to be construed to mean a character the character information for which can be transmitted from a data source to the arrangement for temporary storage therein to form part of an overall character memory. The term "DRCS character set" is to be construed to mean a set of DRCS characters).

Hitherto, a data display arrangement of the above type, in which the display is "character-based" (i.e. the display is made up of discrete characters in specified positions), has generally been accepted as being less suitable for high resolution graphics display compared with a data display arrangement which provides a graphics display using traditional computer graphics techniques. With these techniques, received transmission information provides coded instructions for defining display elements such as vectors, arcs, circles, etc. These instructions are decoded as they are received into dot information for the display elements concerned, and this dot information is stored in the display memory for direct read-out to provide the display. This storage is in so-called "bit-map" form, each pixel (or dot) of the display being represented by at least one stored bit. The amount of storage used by the display memory for such a bit-map display is far greater than that required by the display memory for a character-based display for which whole character memory cells (e.g. a matrix of up to 120 pixels) at a time are identified in the display memory, rather than individual pixels.

SUMMARY OF THE INVENTION

It is an object of the present invention to provide a data display arrangement of the above type in which the use of DRCS characters to provide graphics displays is effected in a manner such as to make the arrangement an attractive alternative to a data display arrangement which provides graphics displays by means of alpha-geometric techniques.

According to the invention, a data display arrangement of the type set forth above, having a plurality of memory sections for storing DRCS character sets, and addressing means for addressing said memory sections one at a time to identify each memory section individually for the read-out of DRCS characters therefrom for display, is characterized in that said addressing means is operable to address a first one of said memory sections for a corresponding first portion of each line scanning period of the raster scan and is further operable to address others of said memory sections for respective further corresponding portions of each said line scanning period, whereby DRCS characters stored in any one of said memory sections are available for display only in a particular sub-area or sub-areas of the total display area of the screen that that memory section is individually identified with by such addressing.

In carrying out the invention, the number of DRCS characters that can be stored in a memory section can be the same as the number of character positions contained in a sub-area. As a result, each DRCS character of a set stored in a memory section can be individually and uniquely associated with a respective character position in the sub-area concerned, which means that each character dot position of a DRCS character can be individually and uniquely associated with a respective pixel position of the character position concerned. By storing a number of dot matrices for a DRCS character, a corresponding number of bits per pixel is provided for coding pixel color choice.

Also, in carrying out the invention, two or more sub-areas of the total display area of the screen may "share" the same DRCS character set as stored in a single memory section, in the sense that any DRCS character of the set is available for display in any character position of any of these two or more sub-areas. This can achieve a reduction in the number of memory sections which are required, but at the expense of not now having sufficient DRCS characters to associate individually with each character position. However, since in many graphics displays only a relatively small part of the total display is detailed, the allocation of the DRCS characters can be such that each character position in fine detail parts of the display has an individual DRCS character uniquely associated with it, while character positions in non-detailed parts of the display share DRCS characters.

The allocation of DRCS character sets can be further extended by providing at least one additional memory section which can accommodate an additional DRCS character set and which can be addressed by said addressing means so as to provide DRCS characters for display at any character position on the total display area of the screen.

BRIEF DESCRIPTION OF THE DRAWINGS

In order that the invention may be more fully understood, reference will now be made by way of example to the accompanying drawings, in which.

DESCRIPTION OF THE PREFERRED EMBODIMENT

Figure 1:
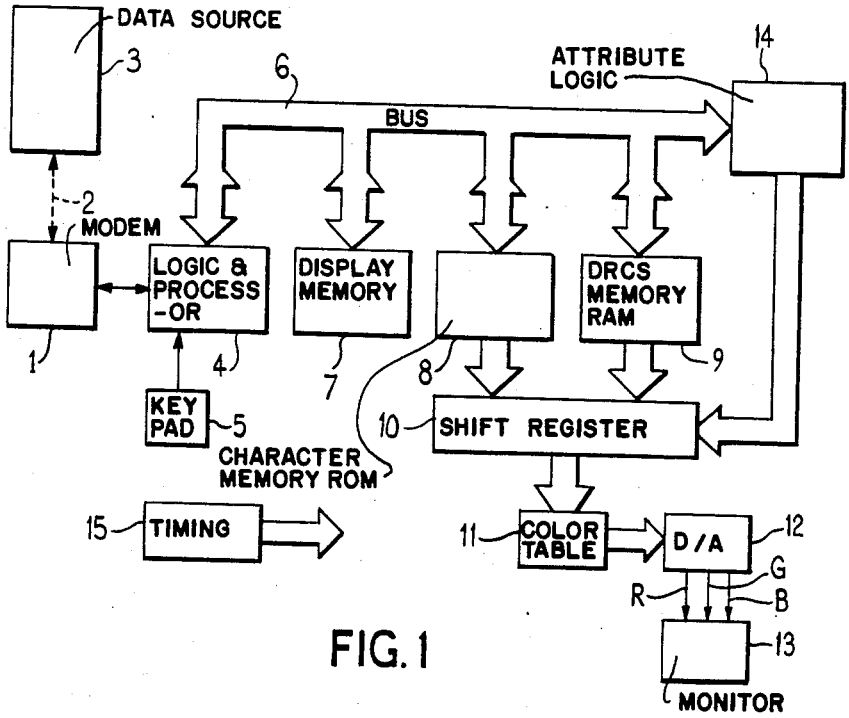
FIG. 1 shows diagramatically a video display terminal having a data display arrangement in which the invention can be embodied.

Referring to the drawings, the video display terminal shown in FIG. 1 has a modem 1 by which the terminal has access over a telephone line 2 (e.g. via a switched public telephone network) to a data source 3. A logic and processor circuit 4 provides the signals necessary to establish the telephone connection to the data source 3. The circuit 4 also includes data acquisition means for acquiring transmission information from the telephone line 2. A command key pad 5 provides user control instructions to the circuit 4. An address/data bus system 6 interconnects the circuit 4 with a display memory 7, a fixed character memory 8 (ROM) and a DRCS character memory 9 (RAM). Under the control of the circuit 4, digital codes derived from the received transmission information and pertaining to characters to be displayed are loaded onto the address/data bus system 6 and assigned to appropriate locations in the display memory 7 as display data. Thereafter, addressing means in the circuit 4 accesses the display data stored in the display memory 7 and uses it to address the character memories 8 and 9, as appropriate, to produce character dot information. Shift registers 10 receive this character dot information and use to to drive a color look-up table 11 to produce therefrom digital color codes which are applied to a digital-to-analog converter 12. The output signals from the converter 12 are the RGB character generating signals required for driving a television monitor 13 to display on the screen thereof the characters represented by the display data. There is also provided attribute logic 14 which contains control data relating to different display attributes, such as "flashing", "underlining", "color choice", "double height", etc. Data which identifies the various attributes to be applied to the displayed characters forms part of the display and is stored in the display memory 7 along with character data which identifies the actual character shapes. The circuit 4 is responsive to the stored attribute data to initiate the relevant attribute control by the attribute logic 14 to implement the attribute(s) concerned for the character display. The attribute data also signifies whether associated character data pertains to a character in the character memory 8 or to a character in the DRCS character memory 9.

The display data in the display memory 7 represents a quantity of stored data which is to be displayed as an entity on the screen of the television monitor 13 and which, to this end, is accessed repeatedly for the display in a recurrent cycle of scanning lines which are produced with or without interlaced field scanning. A timing circuit 15 provides the timing control for this data display. Furthermore, the displayed data is composed of discrete characters arranged in character rows each comprising a number of character positions, and the shapes of the discrete characters are defined by selected dots of a dot matrix which constitutes a character format for the characters.

The timing control is so organized that for each row of characters to be displayed, all the characters of the row are built-up scanning line-by-scanning line as a whole, one dot row for each character is succession, and the rows of characters are built-up in succession. Thus, for the first scanning line for a character row there would be supplied by the character memory 8 or 9, in response to the display data from the display memory 7, the dot information from the first dot row for the first character of the character row, then the dot information from the first dot row for the second character of the character row, and so on for the successive characters of the row. For the second scanning line for the character row the dot information from the second dot row for each character of the row would be supplied in turn, and so on for the remaining scanning lines for the character row.

For the purposes of describing the use of DRCS characters in accordance with the invention, the following criteria will be assumed, although it will be apparent that other criteria are possible within the scope of the invention.

The display on the screen of the television monitor of a single character uses a dot matrix of $12\times10$ character dots in a character display cell which is 10 scanning lines high (V) and 1 $\mu$s. of line scanning period wide (H). A standard 625-line television raster scan in two fields is assumed. The total display area of the screen comprises 25 character rows each containing 40 character positions.

The DRCS memory 9 is composed of a number of memory sections or "chapters" each of which comprises 16K bits of memory which are considered as one thousand and twenty-four 16-bit words each of which contains two 8-bit bytes. A character memory cell consists of ten words each of which contains 12 bits of dot information and 4 bits of mode information. There are seven different DRCS character modes P to V which the mode bits identify and which are shown in the following Table.

TABLE

| | H | V | bits per pixel or character dot | total number of characters per chapter |
|---|---|---|---|---|
| P | 12 | 10 | 1 | 102 |
| Q | 12 | 10 | 2 | 51 |
| R | 6 | 10 | 1 | 2 × 102 |
| S | 6 | 10 | 2 | 102 |
| T | 6 | 10 | 4 | 51 |
| U | 6 | 5 | 2 | 2 × 102 |
| V | 6 | 5 | 4 | 102 |

Therefore, a single chapter of memory of the DRCS memory 9 has a capacity for storing the character information for total numbers of characters of each of the seven DRCS character modes as given in the last column of the above Table.

Figure 2:
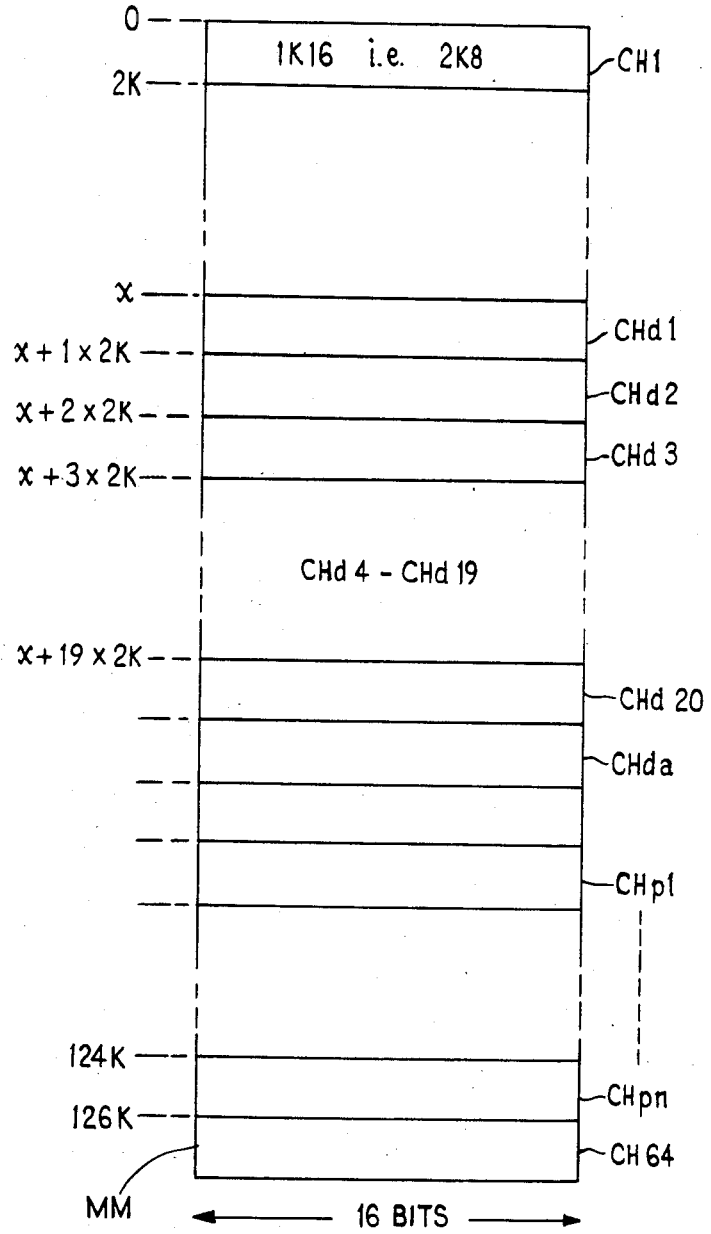
FIG. 2 is a diagram illustrating the memory map of the arrangement of FIG. 1.

FIG. 2 shows diagrammatically the organization of the memory map for the arrangement of FIG. 1. This memory map MM is a random access memory (RAM) and contains a total of sixty-four chapters CH1 to CH64 each of which comprises 1K16 words or 2K8 bytes, as aforesaid. The byte address of the 0 to 2K bytes of each chapter can be identified by a 10-bit address code which addresses the 1024 words, in conjunction with a further bit which identifies the odd or even byte of an addressed word. The sixty-four chapters CH1 to CH64 can themselves be identified by respective code combinations of a 6-bit address code which serves as a so-called "chapter pointer". Certain chapters CHpl to CHpn of the memory map serve as the display memory 7. Each such chapters can store the digital codes for one "page" of data display. Other chapters serve as the DRCS character memory 9. It is assumed for the present purposes that there are twenty chapters CHd1 to CHd20 allocated to serve as the DRCS character memory 9. These twenty chapters are identified by twenty successive 6-bit chapter addres codes, for which the byte addresses will be (x), (x+1×2K), (x+2×2K) . . . (x+19×2K), where x is the first 6-bit code combination of the sequence. It is further assumed for the present purposes that mode T DRCS characters are stored in the DRCS memory 9 so that 50 (51) such characters can be stored in each chapter; that is each character requires two words for its storage. Finally, an additional chapter CHda is also allocated to serve as a part of the DRCS character memory 9.

Figure 3:
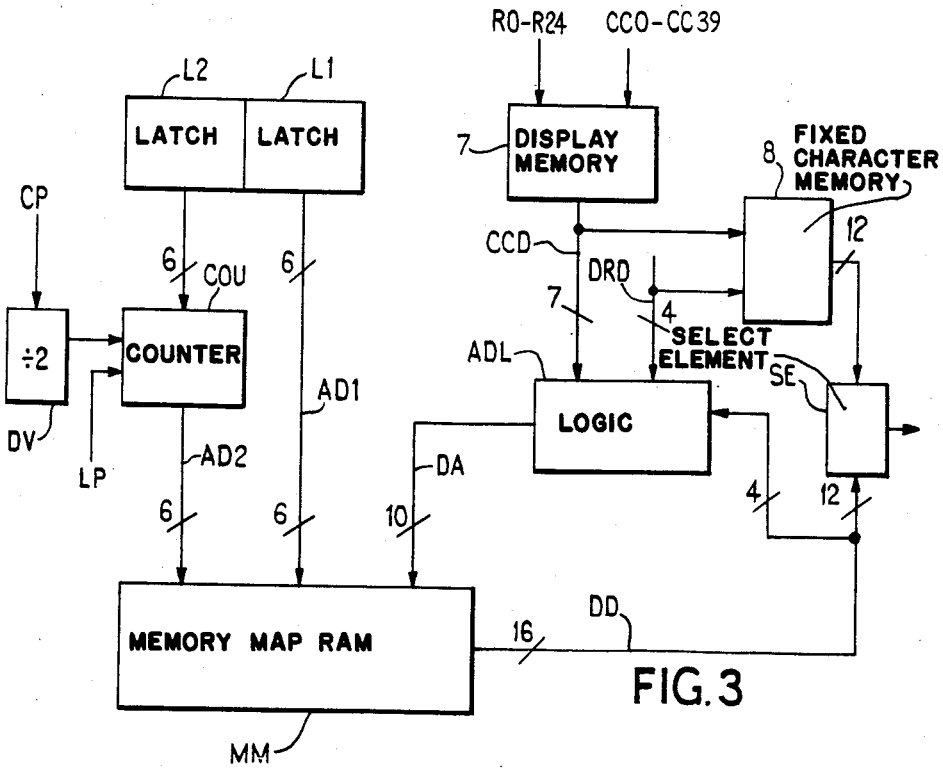
FIG. 3 shows diagrammatically certain elements of the arrangement of FIG. 1 for DRCS addressing in accordance with the invention.

Turning now to FIG. 3, the elements there shown for DRCS addressing are embodied in the logic and processor circuit 4 (FIG. 1). The memory map MM (which accommodates the display memory and the DRCS memory, as aforesaid) and the fixed character memory 8 are also shown. When a display is to use DRCS characters (as previously transmitted from a remote data source and stored in the DRCS memory), this is detected by the circuit 4 from the attribute data stored in the display memory 7 and one of two DRCS chapter latches L1 and L2 is set. When the latch L1 is set, a 6-bit address code is applied over an address bus AD1 as a chapter pointer to identify the additional DRCS chapter CHda of the memory map MM. A DRCS address logic element ADL receives display data read out from the display memory 7 over a 7-bit address bus CCD, this display data identifying the characters to be displayed. The logic element ADL also receives over a 4-bit address bus DRD a dot row address which identifies the particular one of the ten dot rows of a character that is to be displayed on the scanning line concerned. The logic element ADL is responsive to the received display data and dot row address to produce on a 10-bit address bus DA the word address for the word containing a particular dot row of a particular DRCS character in the DRCS chapter CHda.

The information in this word is read out on a 16-bit data bus DD. Twelve bits of this information is dot information which is fed via a select element SE associated with the shift registers 10 (FIG. 1). The remaining four bits of this information is mode information which is fed to the logic element ADL. This mode information is used, for instance in the manner set forth in our copending U.S. patent application Ser. No. 552,654, filed Nov. 17, 1983, to determine a second word address containing the remainder of the information for the character concerned. This latter information is fed via the select element SE to the shift registers 10 which now contain all of the dot information (i.e., 4 bits per pixel) for the mode T character selected. It will be apparent that the DRCS chapter which is identified by the chapter pointer from the address bus AD1 is available for the whole raster scan of the display so that any DRCS character of the set stored in this chapter can be displayed in any character position on the screen of the television monitor.

Figure 4:
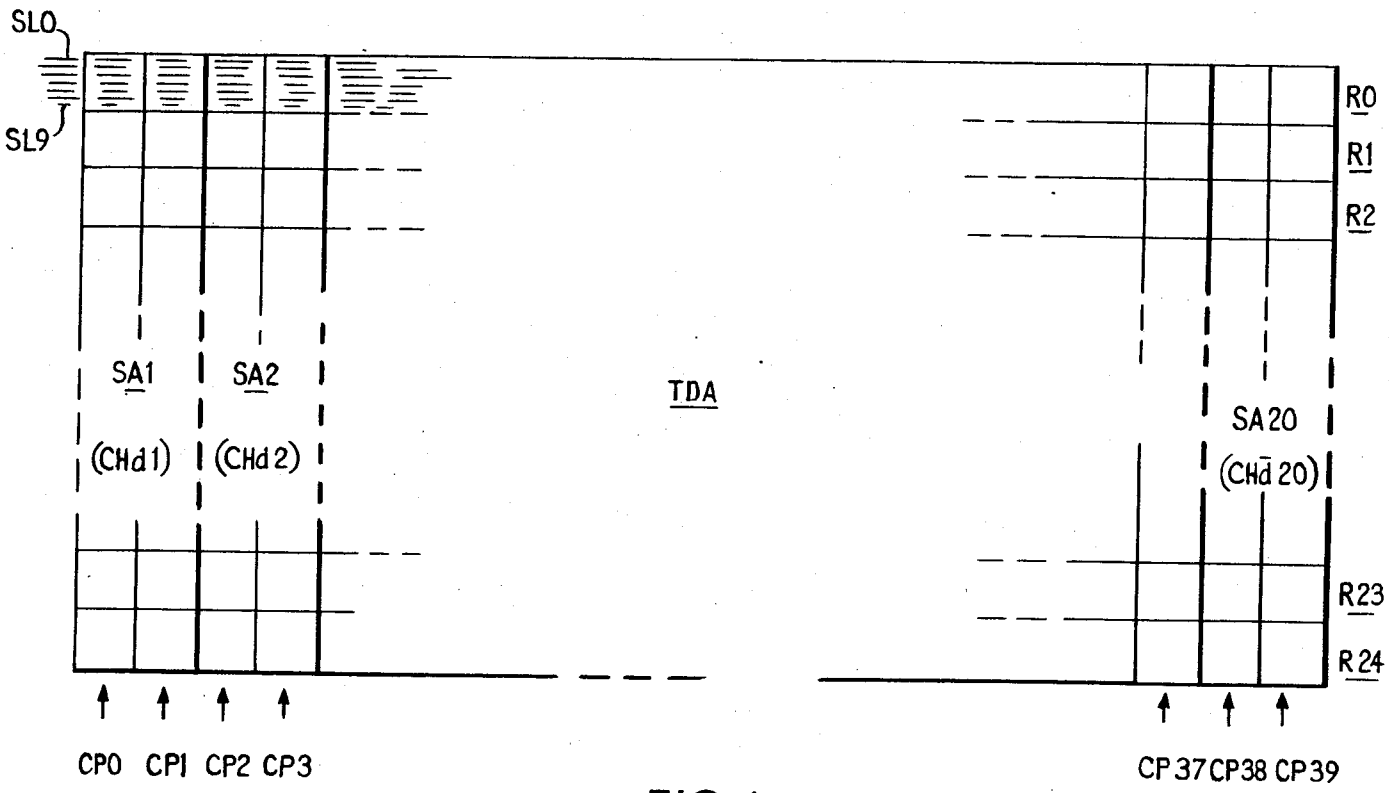
FIG. 4 is a diagram illustrating the theoretical division of a display screen into sub-areas for the purposes of the invention.

In conformity with the invention, the DRCS characters of each of the DRCS character sets which are stored in the DRCS chapters CHd1 to CHd20 are available for display only in any character position of a particular sub-area or sub-areas of the total display area of the screen. For what may be termed "full-field" DRCS data display, each sub-area has the same number of character positions as there are DRCS characters in the set individually associated with that sub-area. FIG. 4 illustrates diagrammatically the theoretical division of the total display area TDA into twenty sub-areas SA1 to SA20. As aforesaid, the total display area contains 25 character rows R0 to R24 each having 40 character positions CP0 to CP39. Each character row is made up of ten scanning lines SL0 to SL9.

The sub-areas SA1 to SA20 are formed from successive pairs of character position columns. Each sub-area therefore contains fifty character positions. Each of the DRCS chapters CHd1 to CHd20, which contains 50(51) mode T DRCS characters, are identified only for a respective portion of each line scanning period by means of a second chapter pointer which is represented by a 6-bit address code on a second address bus AD2. A settable 6-bit counter COU provides this latter 6-bit address code. When "full-field" DRCS data display is to be effected, the latch L2 is latched to the first chapter address (x) for the DRCS chapters CHd1 to CHd20 and this address is set into the counter COU and is loaded onto the address bus AD2 at the beginning of each line scanning period by a pulse LP which occurs at the line scanning frequency. Thus, at the beginning of each line scanning period only the DRCS chapter CHd1 is available to provide DRCS characters for the display. The counter COU is stepped by a divide-by-two circuit DV which is fed with column pulses CP. These column pulses CP occur at the beginning of each character columm position of the display to effectively identify the character positions along the character rows. Thus, for each scanning line period, the DRCS chapter CHd1 is addressed for a portion of that period corresponding to the first two character column positions, and then the count of the counter COU is increased by one so that the second DRCS chapter CHd2 is addressed for a similar pertion of the line scanning period corresponding to the next two character column positions, and so on, until the end of the scanning line period. On the occurrence of the next pulse LP, the counter COU is reset to the original count position to identify the DRCS chapter CHd1 again, and the sequential addressing of the DRCS chapters CHd1 to CHd20 is repeated in the next line scanning period, and thereafter in each successive line scanning period of the complete raster scan. It can be seen from FIG. 4 that the effect of this DRCS chapter addressing is to make each of the DRCS chapters CHd1 to CHd20 available only for a respective one of the sub-areas SA1 to SA20. As a result, each DRCS character of a set stored in one of these chapters can be individually and uniquely associated with a respective character position in the sub-area concerned, which means that each character dot position of a DRCS character can be individually and uniquely associated with a respective pixel position of the character position concerned to provide a high resolution graphics display.

For the sake of completeness, there is also shown in the arrangement of FIG. 3 the fixed character memory 8 which is addressed directly by the character code on bus CCD and dot row number on bus DRD from the display memory 7 to produce dot information for character display using characters from this memory 8. The display memory itself is addressed by character row addresses R0 to R24 and character column addresses CC0 to CC39 to read out the character codes on the bus CCD for the successive characters of the display.

Figure 5:
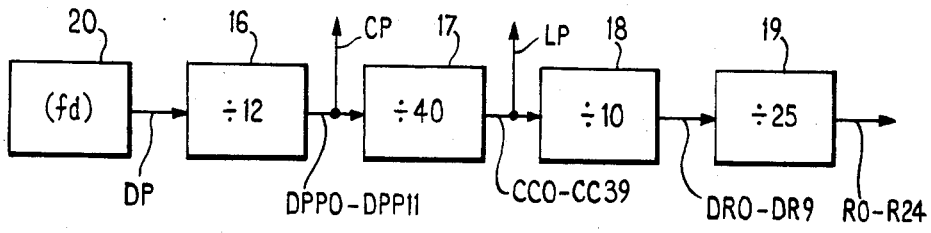
FIG. 5 shows diagrammatically a pulse generating circuit for the elements of FIG. 3.

The various pulses used in the arrangement of FIG. 3 are produced by a pulse counting chain, shown diagramatically in FIG. 5, 5, which forms part of the timing circuit 15 (FIG. 1). This pulse counting chain comprises a numbers of counters 16 to 19 and is fed by dot pulses DP from a pulse generator 20, these dot pulses occurring at a bit frequency fd for the display. The first counter 16 is a modulo- 12 column counter which produces a recurrent cycle of twelve dot pulses DPP0 to DPP11 corresponding to the twelve dot positions of a character dot row. These pulses DPP0 to DPP11 are used (in a manner not shown) to address for serial readout from the shift registers (10-FIG. 1) the successive dots of a character dot row for display. The counter 17, which receives a stepping pulse (column pulse CP) once per cycle of the counter 16, is a modulo-40 character position counter that produces the forty character position addresses CP0 to CP39. The counter 18, which receives a stepping pulse (line pulse LP) once per cycle of the counter 17, is a modulo-10 row counter that produces the dot row addresses DR0 to DR9, and the counter 19, which receives a stepping pulse once per cycle of the counter 18, is a modulo-25 counter that produces the character row addresses R0 to R24.

It will be apparent that less DRCS chapters will be required for a full-field DRCS display when other DRCS characters are used which require less storage space. For instance, 100(102) mode P DRCS characters can be stored in a DRCS chapter, so that only ten DRCS chapters would then be required for full-field DRCS display. This means that each DRCS chapter contains sufficient characters for four character position columns of the display, so that the counter COU has to be stepped only once every fourth character position column, instead of once every second character position column, to provide the appropriate chapter pointer addresses. This change in the stepping rate can readily be effected by changing the divisor number of the divider circuit DV from 2 to 4.

Figure 6:
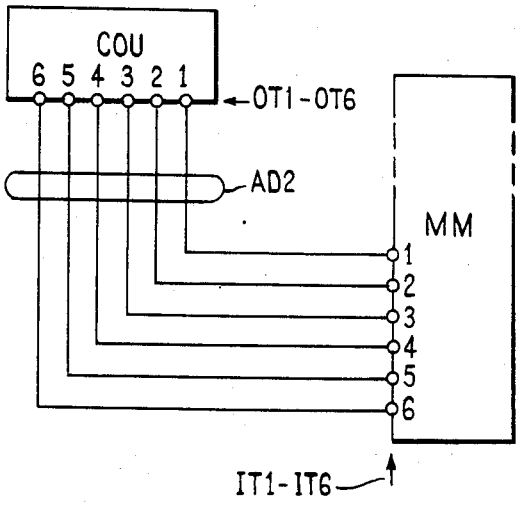
FIGS. 6 and 7 show diagrammatically different address connections for addressing memory sections containing DRCS character sets.
Figure 7:
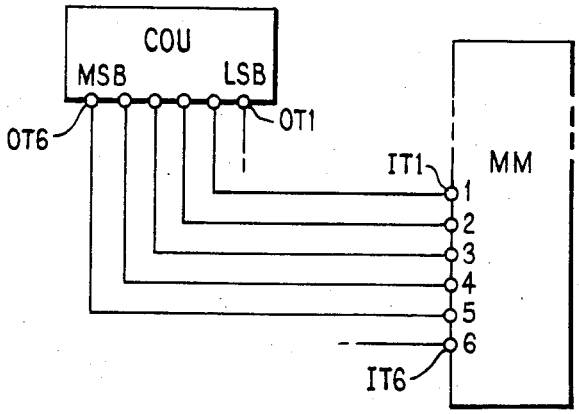

Alternatively, where it is inconvenient to change the operation of the divider circuit DV, for instance when this circuit is embodied in a large scale integrated circuit, the chapter pointer addressing can be altered by modifying the physical connections of the address bus AD2 between the counter COU and the memory map MM. FIG. 6 shows the normal one-to-one connection of each of the address bus connections of the bus AD2 between six output terminals OT1 to OT6 on the counter COU and six input terminals IT1 to IT6 on the memory map MM. FIG. 7 shows the modified address bus connections of the bus AD2 for addressing only half the number of DRCS chapters, while maintaining a divisor of 2 for the divider circuit DV. In these modified address bus connections, the least significant bit output terminal OT1 of the counter COU is left unconnected and each of the other output terminals OT2 to OT6 are connected respectively to the input terminal of one less significant bit value of the memory map MM, leaving the most significant bit input terminal IT6 unconnected. As a result of these modified address connections, the chapter pointer address as applied to the memory map MM is now sequenced once every second address change produced by the counter COU as the least significant bit is effectively "lost". This principle for modifying the address bus connections can be extended so that two (or more) least significant bits can be effectively "lost" to maintain each address chapter pointer as applied to the memory map MM for four (or more) successive address changes as produced by the counter COU.

Instead of having sufficient DRCS chapters to provide individual DRCS characters for each character position of the total display area, a lesser number of DRCS chapters can be provided so that two (or more) sub-areas "share" the same DRCS chapters. Depending on the number of DRCS characters per chapter, the chapter addressing would be implemented as already described for a full-field DRCS display. The contents of the display memory 7 can assign DRCS characters of an addressed chapter to selected character positions in the sub-areas concerned, these positions corresponding to fine detail and having DRCS characters uniquely associated with them. Unfilled character positions of the sub-areas can be assigned characters from the fixed character memory 8 (usually spaces) or characters from the DRCS chapter memory CHdn which is available for the total display area.

I claim:

1. A data display arrangement for displaying as an entity on a screen of a raster scan display device, a quantity of data represented by digital codes stored in a display memory and accessed repeatedly for the display in a recurrent cycle of scanning lines, the displayed data being composed of discrete characters organized in character rows each comprising a plurality of character positions, and each discrete character's shape being defined by selected dots of a dot matrix which constitutes a character format for the characters; said arrangement comprising a character memory for storing character information in bit pattern form and addressing means for selectively addressing said character memory in accordance with the stored digital codes to read out therefrom character information for the display; and wherein said character memory comprises a plurality of memory sections for storing character information representing DRCS character sets and said addressing means is operable to address a first one of said memory sections for a corresponding first portion of each line scanning period of the raster scan and is further operable to address at least one other of said memory sections for a further, or a respective further, corresponding portion of each said line scanning period thereby dividing said display into sub-areas, whereby DRCS characters stored in any one of said memory sections are available for display only in each sub-area of the screen that that memory section is individually identified with by such addressing.

2. A data display arrangement as claimed in claim 1, characterized in that each memory section has a capacity for storing as many DRCS characters as there are character positions in one of said sub-areas of the screen.

3. A data display arrangement as claimed in claim 2, characterized in that two or more sub-areas of th screen "share" the same DRCS character set as stored in a single memory section in the sense that any DRCS character of the set is available for display in any character position of either of said two or more sub-areas.

4. A data display arrangement as claimed in any one of claims 1, 2 or 3 further comprising at least one additional memory section. which can accommodate an additional DRCS character set and which can be addressed by said addressing means so as to provide DRCS characters for display at any character position on the screen.

5. A data display arrangement as claimed in claims 1, 2 or 3, comprising logic and processor means for controlling the operation of the arrangement; characterized in that said addressing means is incorporated in said logic and processor means and includes a latch which in respect of a display using DRCS characters is latched to the address of said first memory section at the beginning of a raster scan, the addressing means further including a multi-bit address counter which is set by said latch to an initial count corresponding to said address of said first memory section, and divider means responsive to (column) pulses which identify character positions along a character row to step the counter to provide the addressess of said other memory sections in turn in response to every nth column pulse ($n \geqq 1$), the counter being reset to its initial count at the beginning of each line scanning period.

6. A data display arrangement as claimed in claim 5, characterized in that said counter is stepped every second column pulse.

7. A data display arrangement as claimed in claim 5, characterized in that an address bus over which the memory section addresses are applied from the counter to address the DRCS memory sections comprises a plurality of bus connections which extend between a plurality of output terminals of the counter and a plurality of input terminals which are common to the memory sections, of which bus connections, the least significant bit output terminal of the counter is left unconnected and each of the other output terminals are connected respectively to the input terminal of one less significant bit value of the memory sections, leaving the most signficant bit input terminal unconnected.

8. A data display arrangement as claimed in claim 7, modified in that two or more least significant bit output terminals are left unconnected, to leave a corresponding number of most significant bit input terminals unconnected, the remaining output terminals being respectively connected to the remaining input terminals in accordance with their bit value order.

9. A data display arrangement as claimed in claim 1 further comprising at least one additional memory section which can accommodate an additional DRCS character set and addressable by said addressing means so as to provide DRCS characters for display at any character position on the screen, and logic and processor means for controlling the operation of the arrangement; characterized in that said addressing means is a part of said logic and processor means and includes a latch which for a display using DRCS characters is latched to the address of said first memory section at the beginning of a raster scan, the addressing means further including a multi-bit address counter which is set by said latch to an initial count corresponding to said address of said first memory section, and divider means responsive to (column) pulses which identify character positions along a character row to step the counter to provide the addresses of said other memory sections in turn in response to every $n^{th}$ column pulse ($n \geqq 1$), the counter being reset to its initial count at the beginning of each line scanning period.

* * * * *